US010122114B1

(12) United States Patent
Kang

(10) Patent No.: US 10,122,114 B1
(45) Date of Patent: Nov. 6, 2018

(54) AUTOMATION COMPONENT KEYING SYSTEM AND METHOD

(71) Applicant: ROCKWELL AUTOMATION ASIA PACIFIC BUSINESS CENTER PTE. LTD., Singapore (SG)

(72) Inventor: Soon Seng Kang, Singapore (SG)

(73) Assignee: Rockwell Automation Asia Pacific Business Center Pte. Ltd., Singapore (SG)

( * ) Notice: Subject to any disclaimer, the term of this patent is extended or adjusted under 35 U.S.C. 154(b) by 0 days.

(21) Appl. No.: 15/692,774

(22) Filed: Aug. 31, 2017

(51) Int. Cl.
*H01R 13/436* (2006.01)
*H01R 13/508* (2006.01)
*H01R 13/506* (2006.01)

(52) U.S. Cl.
CPC ..... *H01R 13/4364* (2013.01); *H01R 13/4367* (2013.01); *H01R 13/506* (2013.01); *H01R 13/508* (2013.01)

(58) Field of Classification Search
CPC ..... H01R 13/645
USPC ..... 439/681
See application file for complete search history.

(56) References Cited

U.S. PATENT DOCUMENTS 4,081,779 A * 3/1978 Ranzanigo ..... H01R 13/645 337/198
5,027,091 A * 6/1991 Lesslie ..... H01H 71/7409 335/132
5,273,462 A * 12/1993 Huser ..... H01R 13/645 439/341
5,354,211 A * 10/1994 Svette, Jr. ..... H01R 13/631 439/381
6,068,521 A * 5/2000 Oros ..... H01R 13/645 439/681
6,302,745 B1 * 10/2001 Landis ..... H01R 13/6453 439/681
7,077,702 B2 * 7/2006 Ward ..... H01R 13/4364 439/292
8,075,350 B2 * 12/2011 Heggemann ..... H01R 13/6453 439/680
8,951,074 B2 * 2/2015 Severac ..... H01R 9/2408 439/681
9,281,577 B2 * 3/2016 Lisbona ..... H01R 9/226
9,362,685 B2 * 6/2016 Lostoski ..... H01R 13/6608
9,966,714 B1 * 5/2018 Sreedharan ..... H01R 25/142

* cited by examiner

*Primary Examiner* — Neil Abrams
(74) *Attorney, Agent, or Firm* — Fletcher Yoder, P.C.

(57) ABSTRACT

This disclosure regards a self-keying system for an input/output (I/O) device. An I/O module mountable on a terminal base exchanges I/O signals with external devices via the terminal base. The I/O module comprises a key, and the terminal base comprises a locking assembly to allow insertion of only compatible I/O modules into the terminal base. The locking assembly comprises parallel slots containing a plurality of lock pins movable in the slots between a biased position and a second position. A blocking member is actuated by the key to block each of the lock pins in their respective position to key the base. A maintaining member maintains the blocking member in the keyed position. After keying, a non-compatible key would be rejected from the locking assembly due to the blocked lock pins. A reset to the unkeyed configuration may be accomplished without the use of tools by actuating the maintaining member.

20 Claims, 8 Drawing Sheets

AUTOMATION COMPONENT KEYING SYSTEM AND METHOD

BACKGROUND

This disclosure relates generally to physical connections between an input/output (I/O) module and a terminal base in automation systems.

In general, I/O interfaces used in automation systems provide a method for transferring information between sensors, actuators, and automation components that include processors, external devices, internal memory, and external memory. Generally, the I/O module may perform various modifications of signals, while a terminal base supplies connections to peripheral devices, such as sensors and actuators, or processors. Peripheral devices may be electromechanical, electromagnetic, or simple electronic devices. I/O modules may act as a hub or receiving and distribution point for many different devices that provide signals used in automation processes, and signals that command operation of automation components in performing parts of such processes.

Furthermore, such modular I/O may be programmed to exchange signals or data derived from the signals with other automation components in specific ways. The use of a configured I/O module in a system leads to the requirement that only the correct I/O module be coupled to and implemented with the terminal base where it is to be used and the specific components connected via terminals in the base.

Keying systems on I/O interfaces allow only the I/O module with a proper key to fit into a terminal base that has been configured with a keying base to physically receive only that key. The I/O module with the proper key may be placed into the terminal base with no restriction, but an I/O module with a different key may be physically rejected from the base. The removal and engagement of I/O modules may be required due to replacement or upgrade. Additionally, if an upgrade is desired, it may be necessary to change the keying base to prevent the previous module from being placed in the terminal base. Unfortunately, keying bases are generally time consuming to configure and may be permanent once set.

BRIEF DESCRIPTION

In one embodiment, a keying system for an automation device may include an input/output (I/O) terminal base and an I/O module mountable on the terminal base. In operation, the I/O module exchanges I/O signals with external devices via the terminal base. The I/O module includes a key, and the terminal base includes a locking assembly. The locking assembly includes a housing having parallel slots and a plurality of lock pins movable in the slots between a first, biased position and a second position and each lock pin having a locking structure. The locking assembly also includes, a blocking member that, in operation, is actuated to interface with the locking structures to block each of the lock pins in the respective first or second position and a maintaining member that, in operation, contacts the blocking member to maintain the blocking member in a blocking position in which each of the lock pins is blocked in the respective first or second position. Each lock pins can be displaced between the respective first and second positions by the key that has engaging surfaces that contact the lock pins to define keyed positions of the lock pins. The blocking member blocks the lock pins in their keyed positions and the maintaining member maintains the blocking member in the blocking position thereby blocking mounting of other I/O modules not having the key.

In another embodiment, a keying system for an automation device may include a base configured to perform an automation operation and a modular automation device mountable on the base and that, in operation, exchanges signals with the base. The modular automation device may include a key. The keying system may also include a locking assembly on the base. The locking assembly may include a housing having parallel slots, a plurality of lock pins movable in the slots between a first, biased position and a second position and each having a locking structure, a blocking member that, in operation, is actuated to interface with the locking structures to block each of the lock pins in the respective first or second position, and a maintaining member that, in operation, contacts the blocking member to maintain the blocking member in a blocking position in which each of the lock pins is blocked in the respective first or second position. Each of the lock pins can be displaced between the respective first and second positions by a key having engaging surfaces that contact the lock pins to define keyed positions of the lock pins. The blocking member blocks the lock pins in their keyed positions and the maintaining member maintains the blocking member in the blocking position thereby blocking mounting of other modular automation devices not having the key.

In another embodiment, a keying method for an automation device may include, in a system that comprises an input/output (I/O) terminal base and an I/O module with a key mountable on the terminal base and that, in operation, exchanges I/O signals with external devices via the terminal base, biasing a plurality of lock pins each movable between a first, biased position and a second position. The method may further include actuating a blocking member to interface with locking structures of the lock pins to block each of the lock pins in the respective first or second position, and contacting the blocking member with a maintaining member to maintain the blocking member in a blocking position in which each of the lock pins is blocked in the respective first or second position. Each of the lock pins can be displaced between the respective first and second positions by a key having engaging surfaces that contacts the lock pins to define keyed positions of the lock pins, and wherein the blocking member blocks the lock pins in their keyed positions, and the maintaining member maintains the blocking member in the blocking position thereby blocking mounting of other I/O modules not having the key.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The disclosure relates generally to physical connections between an input/output (I/O) module and a terminal base. In automation systems, I/O modules are used for receiving and providing signals and data between automation components, such as sensors, actuators, processing components, monitoring and control components, and so forth, and may be implemented by a physical connection to a terminal base connected to one or more such devices. These devices may be in use in large systems such as industrial automation, as well as in smaller systems, OEM equipment, and so forth.

A further employment of an I/O module may be to manage multiple devices at once. Such management may include simply receiving signals and data from sensors during operation of an automated process, outputting signals and data to actuators, exchanging signals and data with monitoring and/or control devices, and so forth. One embodiment of multi-device management may also include multiple I/O modules attached to multiple terminal bases. The bases may also be interconnected to supply further connections. In addition to providing and exchanging signals and data, the I/O modules may provide power for operation of peripherals, particularly sensors and actuators.

Keying systems on I/O interfaces allow only the I/O module with a proper key to fit into a terminal base that has been configured with a keying base to physically receive only that key. The I/O module with the proper key may be placed into the terminal base with no restriction, but an I/O module with a different key may be physically rejected from the base. The removal and engagement of I/O modules may be required due to replacement or upgrade. Additionally, if an upgrade is desired, it may be necessary to change the keying base to prevent the previous module from being placed in the terminal base. Unfortunately, keying bases are generally time consuming to configure and may be permanent once set. The embodiment of the present disclosure illustrates an I/O device that utilizes a keying system that can be automatically keyed with the first insertion of a key, and may be reset to an unkeyed configuration without the use of any tools.

Figure 1:
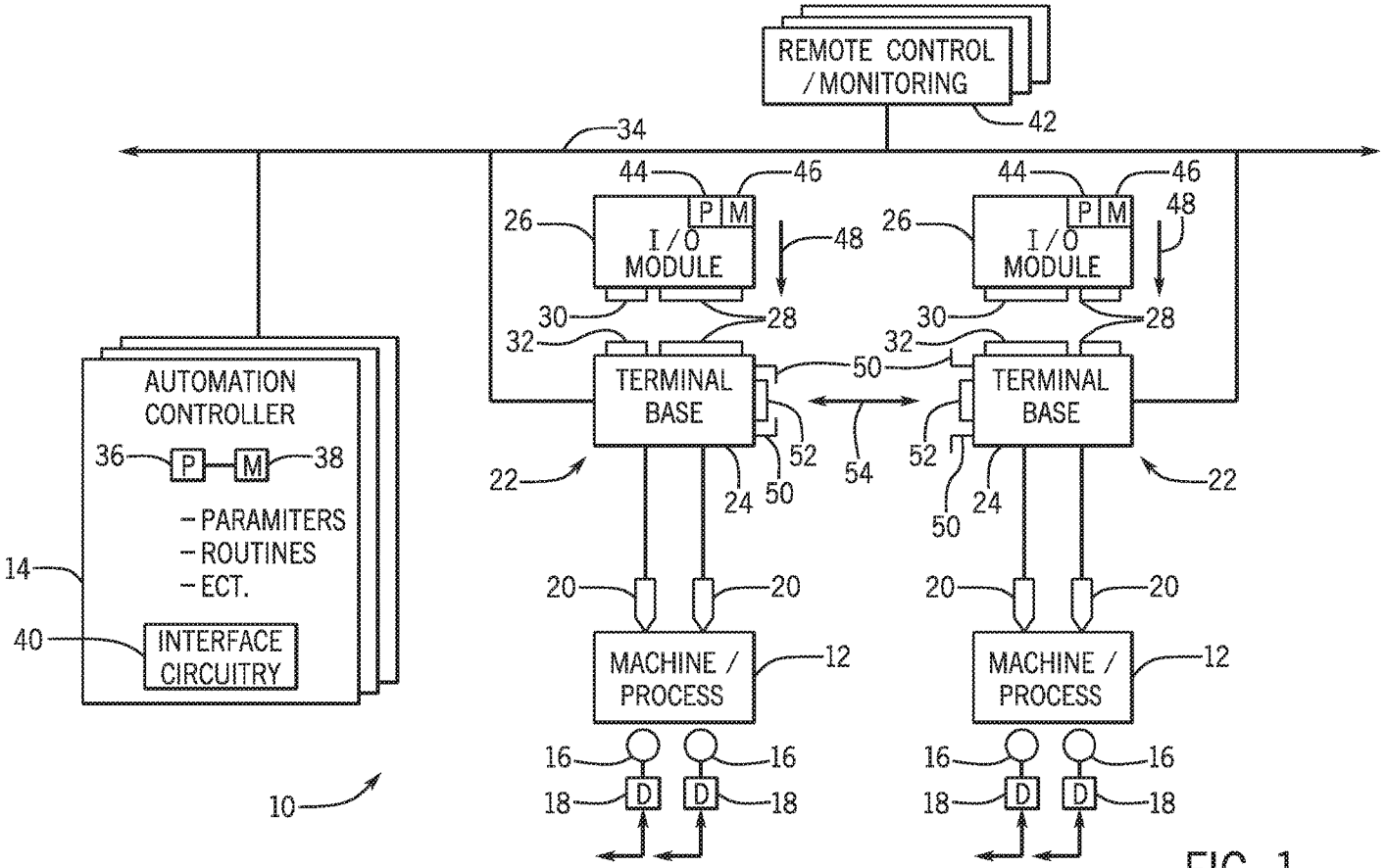
FIG. 1 is a diagrammatical view of an automation system that monitors and/or controls a machine/process via a controller utilizing aspects of the disclosed technique.

With the foregoing in mind, FIG. 1 illustrates one implementation of an I/O device in the form of an industrial automation system 10 in which a machine or process 12 is controlled by an automation controller 14. The machine or process 12 may cause one or more actuators 16 and/or drives 18 to be energized or enabled. The actuators 16 may be electrical or electromechanical in nature and may include, for example one or more drives 18 operated directly or indirectly in response to feedback signals from sensors 20 or control signals from the controller 14. Drives 18 may provide controlled power to motors to carry out industrial automation tasks (e.g., operation of a pump, conveyor, transmission equipment, and so forth). The system 10 may further be part of a larger automation system that automates entire groups of tasks, such as for manufacturing, material handling, mining, or any other useful application.

To facilitate communication between the machine or process 12, the automation controller 14, sensors 20, and/or other machines or processes, an I/O device 22 is employed that allows for receiving, providing, exchanging, and where desired at least partially processing or conditioning signals and data. A terminal base 24 facilitates wired and/or wireless connections from the automation controller 14, sensors, 20, and/or a machine or process 12 to an I/O module 26 via a physical connection 28. The I/O module 26 may transmit signals and data, and where desired may compute, process, and/or communicate signals and data to and from the connected devices. I/O devices 26 are modular in that they can be removed from the terminal base 24 and be replaced, configured, or upgraded with relative ease. The physical connection 28 made between the I/O module 26 and the terminal base 24 facilitates signal transmission of signals to and from the I/O module, and may be common among many I/O modules configured for different implementations.

To ensure matching and proper operation of the correctly configured I/O module with the desired terminal base, only a specific I/O module 26 should be connected to a matching terminal base 24. To ensure such matching, a keying system comprising a key 30 and a keying base 32 are employed on the I/O module and terminal base 24 respectively. It also may occur to those skilled in the art to place the keying base 32 on the I/O module 26, and the key 30, on the terminal base 32. If the I/O module 26 has the key 30 for which the keying base 32 is set, the physical connection 28 between the I/O module and the terminal base 24 can then be made, allowing for appropriate signals and data exchange via the I/O module with a system network 34.

The network 34 maintains connections between the plurality of devices of the system 10, including one or more automation controllers 14. The automation controllers 14 will typically include one or more processors 36, which may be any suitable types, such as field programmable gate arrays, multi-core processors, or any other suitable processing circuits. The processors 36 are coupled to memory circuitry 38 that stores a range of configuration routines, operating routines, settings, and so forth. The memory circuitry 38 may be of any suitable type, including volatile and non-volatile memory. The processors 36 are also connected to interface circuitry 40 to allow communications with other devices such as a human interface module (HIM) or other auxiliary circuitry.

Further, the system 10 may be in physical, data and/or logical communication with other systems and components via the network 34, both wired and wireless, at a single location or at dispersed locations in an organization. Additionally, the network 34 may employ remote control/monitoring components 42 to facilitate further management of the system 10.

The I/O module 26 may include one or more self-contained processors 44 and memory units 46. These processors 44 may be any suitable types, such as field programmable gate arrays, multi-core processors, or any other suitable processing circuits. Here again, the memory circuitry 38 may be of any suitable type, including volatile and non-volatile memory.

To make the physical connection 28 between I/O module 26 and the terminal base 24, the I/O module is pressed into the terminal base as shown by reference arrow 48. The depiction of the connection 28 being made by arrow 48 is for illustration of one possible embodiment, and is not limiting. Additionally, connections between terminal bases 24 may be made for expansion of the network 34 and system 10. These connections may include a mechanical interlock 50 and/or an electrical interface 52. Reference arrow 54 depicts the joining of two terminal bases 24.

As one skilled in the art would appreciate, the use of I/O devices 22, and therefore keys 30 and keying bases 32, is not limited to industrial automation systems, and the scope of this disclosure is not limited as such.

Figure 2:
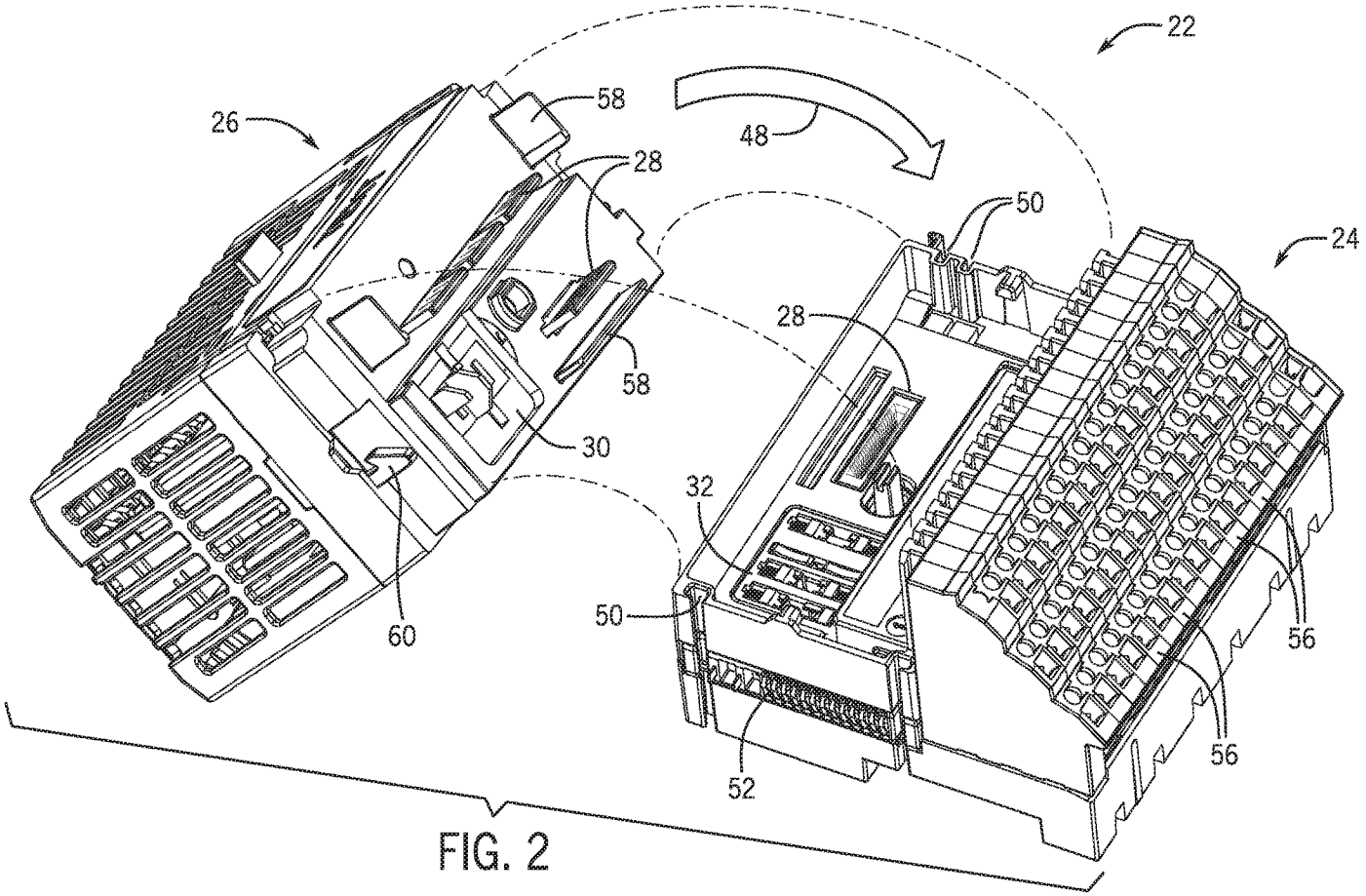
FIG. 2 is an illustration of an input/output module and terminal base utilizing a keying system.

FIG. 2 depicts one embodiment of an I/O device 22 employing a key 30 and a keying base 32 on the I/O module 26 and terminal base 24 respectively. The terminal base 24 comprises a plurality of connectors 56 to facilitate connections with the network 34, automation controller 14, machine or process 12, or any other component of the system 10. These connectors 56 may provide connection via wires, optical cables, wirelessly (via antennae), and/or mechanical linkages. Such a linkage could be made to operate contacts on or within the terminal base 24.

Additionally, the I/O module 26 may include alignment fins 58 for facilitating proper alignment of the electrical interface 28 and keying system when mounted to the terminal base 24 as shown by reference arrow 48. As might be apparent to anyone skilled in the art, depending on the configuration of the I/O module 26 and terminal base 24, the attachment (see arrow 48) may be via a linear movement (e.g., vertical or horizontal) or rotary movement. If the keying base 32 is keyed for the key 30 of the I/O module 26, a complete connection can be made and a retaining mechanism 60 may be utilized to prevent inadvertent removal of the I/O module. This retaining mechanism may be a clasp, clip, snap, toggle, screw, or other form of non-permanent attachment.

Figure 3:
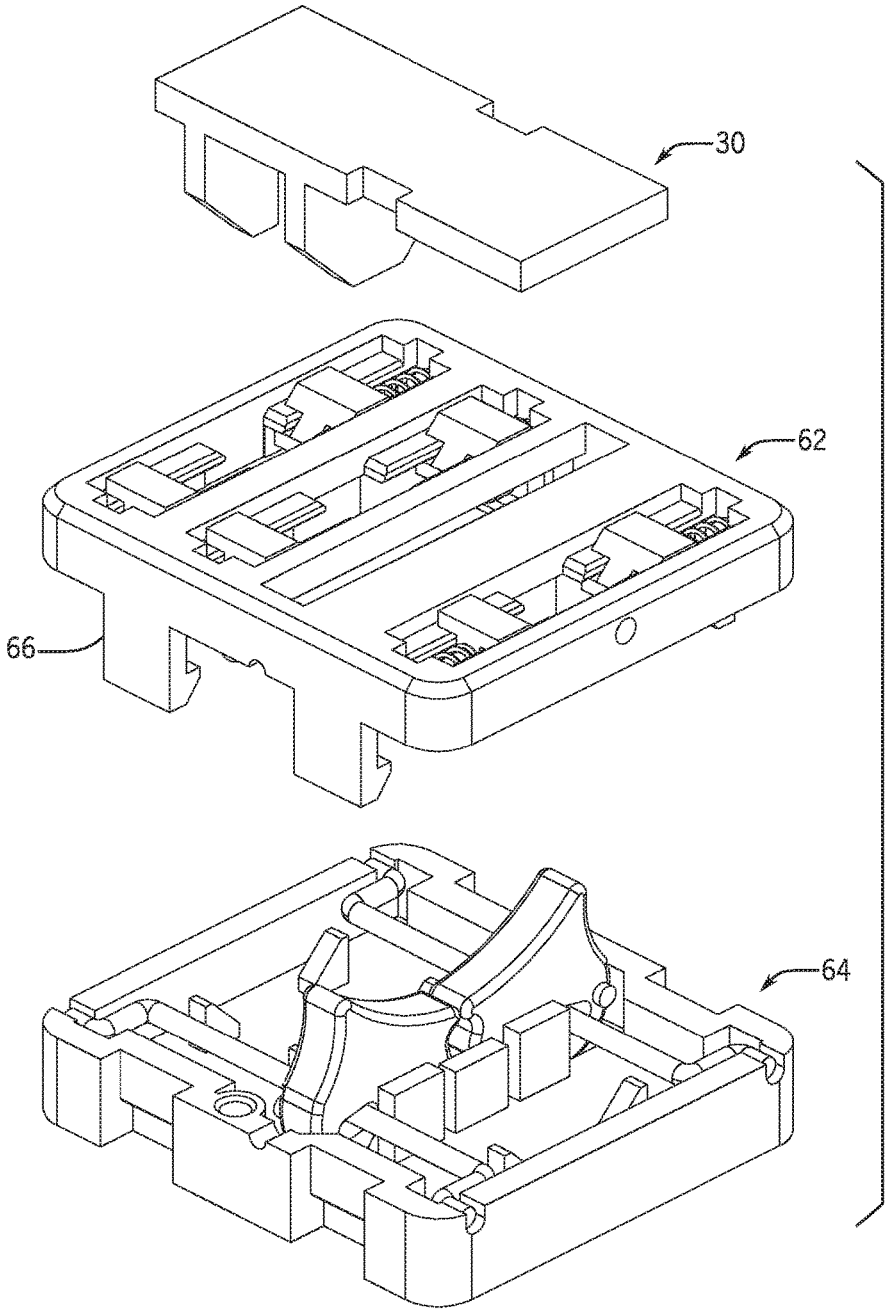
FIG. 3 is an exploded illustration of a keying system.

The keying system may be comprised of three main bodies as depicted in FIG. 3, namely, a key 30, a top cover assembly 62, and a bottom cover assembly 64. The top cover assembly 62 attaches to the bottom cover assembly via a retaining mechanism 66. This retaining mechanism 66 may be in the form of a built-in retention, such as a molded part, a clasp or clip, or a separate fastener such as a screw or rivet.

Figure 4:
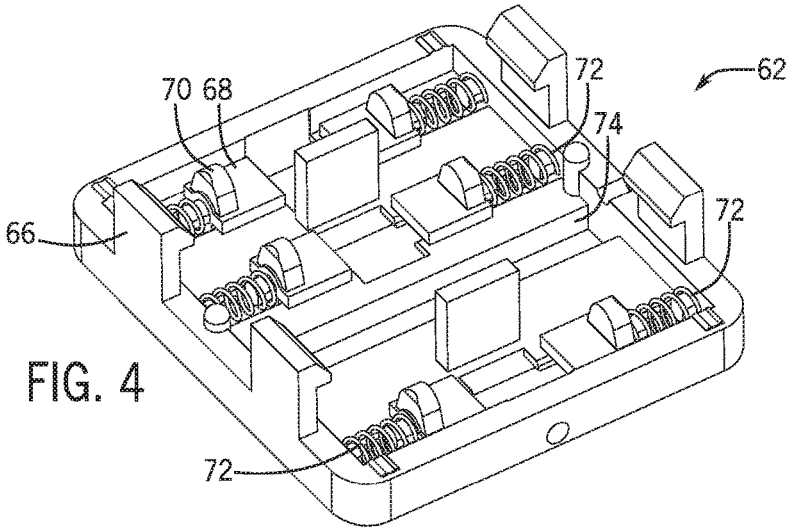
FIG. 4 is an inverted illustration of certain aspects of FIG. 3.

FIG. 4 illustrates an inverted view of the top cover assembly 62. In the illustrated embodiment, the top cover assembly 62 comprises a plurality of lock pins 68 maintained in parallel slots. Lock pins 68 are disposed on opposite sides of each of the slots to provide more keying combinations. Each lock pin has a pin backing 70 for use in securing the pin in a keyed position. The default position of the lock pins 68 is achieved by biasing members or springs 72. The illustrated embodiment depicts a compression spring 72 for biasing the lock pins 68 to their default biased position, however many different biasing mechanisms may be employed by someone skilled in the art such as tension springs, an inherent biasing by a compressed piece of material of the lock pin itself (e.g., a molded or attached part), or any component or material that would result in a restoring force when the lock pin is moved from the default biased position. In some embodiments, slots or passages may include perpendicular or angled portions.

Figure 5:
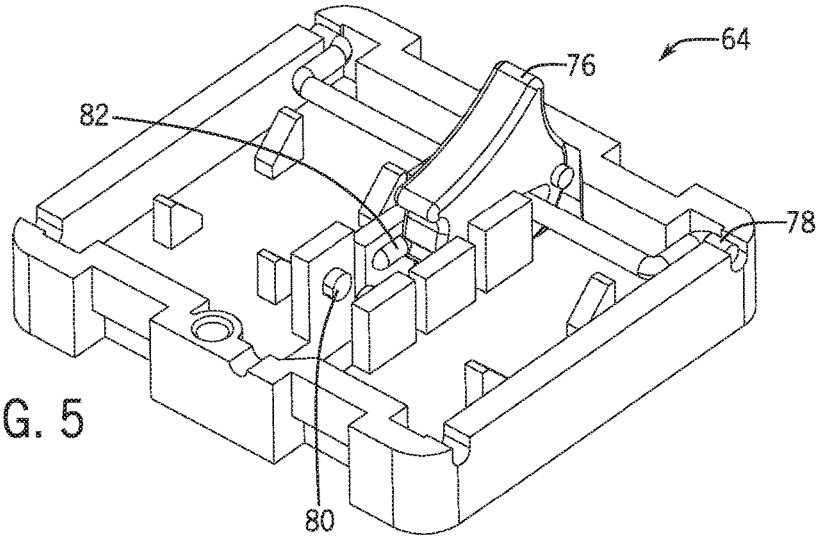
FIG. 5 is an inverted illustration of certain aspects of FIG. 3 with some components removed for clarity of view.

Additionally, an open slot 74 is provided on the face of the top cover assembly 62 to allow components from the bottom cover assembly 64 to be actuated. The bottom cover assembly 64 displayed in FIG. 5, along with one or more maintaining levers 76, fits together with the top cover assembly 62 such that the maintaining levers can be accessed via the open slot 74.

The maintaining levers 76 pivot to actuate one or more blocking bars 78 which, depending on configuration state, may block lock pins 68 from moving. These blocking bars pivot in grooves cut out of the bottom cover assembly 64, top cover assembly 62, or both. The present embodiment employs two maintaining levers 76 and two blocking bars 78 of which one of each is removed in FIG. 5 for ease of viewing. Maintaining levers 76 pivot on a pivot points 80 connected to the bottom cover assembly 64. This pivot point 80 may comprise a pin, half pin, ball joint, or any suitable pivot hardware for allowing controlled motion of the maintaining lever 76. Additionally, a detent 82 is employed to keep the maintaining lever 76 from inadvertent movement, but allows the maintaining lever to actuate given a small applied force. The detent 82 may fit in a grove on the maintaining member 76 and may be in the form of a friction lock, a material protrusion, a spring loaded retaining device, or any retaining mechanism that is overcome by small applied force.

Figure 6:
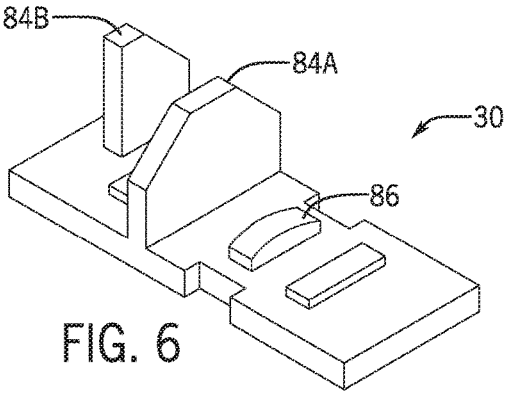
FIG. 6 is an inverted illustration of certain aspects of FIG. 3.

FIG. 6 illustrates a key 30 to be attached to the I/O module 26. The key 30 incorporates one or more keying fins 84 that may be two sided, such as keying fin 84A, one sided, such as 84B, or have no protrusions beyond the center of the key. When keying is taking place, the keying fins 84 are configured to contact the lock pins 68 and move them to keyed positions. If keying has already taken place, the keying fins 84 are configured to be rejected by the lock pins 68 if the key 30 does not match the keying base 32, or if the key does match, the keying fins will not be inhibited by the lock pins. Additionally, the key 30 also incorporates a lever actuator 86 configured to actuate the maintaining lever 76 when in the unkeyed configuration.

Figure 7B:
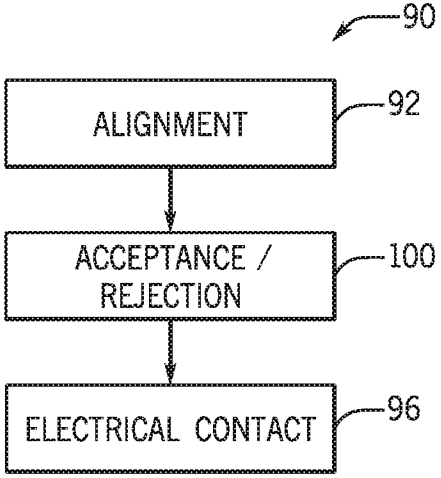
FIG. 7B is a flow chart illustrating the process of inserting a key into a base while the base is in an keyed configuration.
Figure 7A:
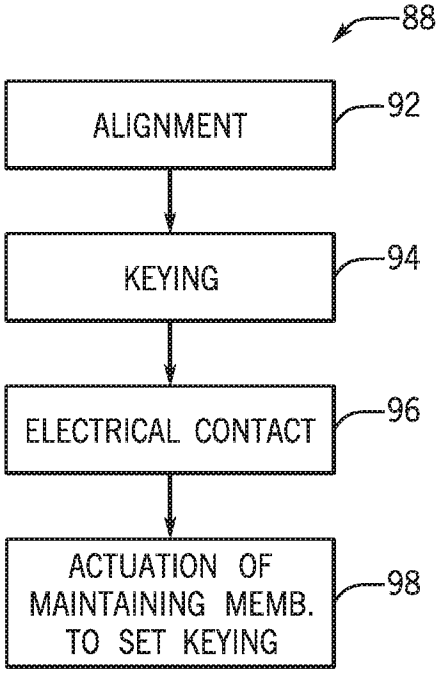
FIG. 7A is a flow chart illustrating the process of inserting a key into a base while the base is in an unkeyed configuration.

The two configurations of the keying base 32, unkeyed and keyed, lead to two possible processes for inserting an I/O module 26 into a terminal base 24 as depicted by flow diagrams in FIG. 7A and FIG. 7B with an unkeyed process 88, and a keyed process 90. The unkeyed configuration process 88 begins with an alignment stage 92 where the I/O module 26 is aligned with the terminal base 24 using the alignment fins 58 as a guide. With the I/O module 26, and therefore key 30, properly aligned, the key is pressed into the keying base 32 beginning the keying stage 94. As the key 30 is inserted, the keying fins 84 displace the lock pins 68 from their default biased position. The contact stage 96 delineates the electrical connection 28 being made between the I/O module 26 and the terminal base 24. The actuation stage 98 completes the connection and keying process when the lever actuator 86 actuates the maintaining lever 76, pivoting the blocking bar 78 to hold the lock pins in place, thus automatically keying the base for that particular key without the need of any additional tools. After the keying process is completed, the I/O module 26 may be removed.

With the keying base 32 in the keyed configuration, an I/O module 26 may be inserted into the terminal base 24 following the keyed process 90. As with the unkeyed process 88, the keyed process 90 begins with an alignment stage 92 for allowing proper connections to be made between the I/O module 26 and the terminal base 24. An acceptance/rejection stage 100 begins when the key 30 comes in contact with the keying base 32. Since the keying base 32 has already been keyed, a compatible key 30 will be accepted into the keying base allowing further insertion of the I/O module 26 into the terminal base 24. However, if the key 30 is not compatible with the keyed keying base 32, the keying fins 84 will be rejected by the lock pins 68 stopping further insertion of the I/O module 26 into the terminal base 24. If the key 30 is accepted, a contact stage 96 will follow, and the electrical connection 28 will be made between the I/O module 26 and the terminal base 24. It should be noted, that the acceptance/rejection stage 100 occurs before any electrical connection 28 can be made.

Figure 8A:
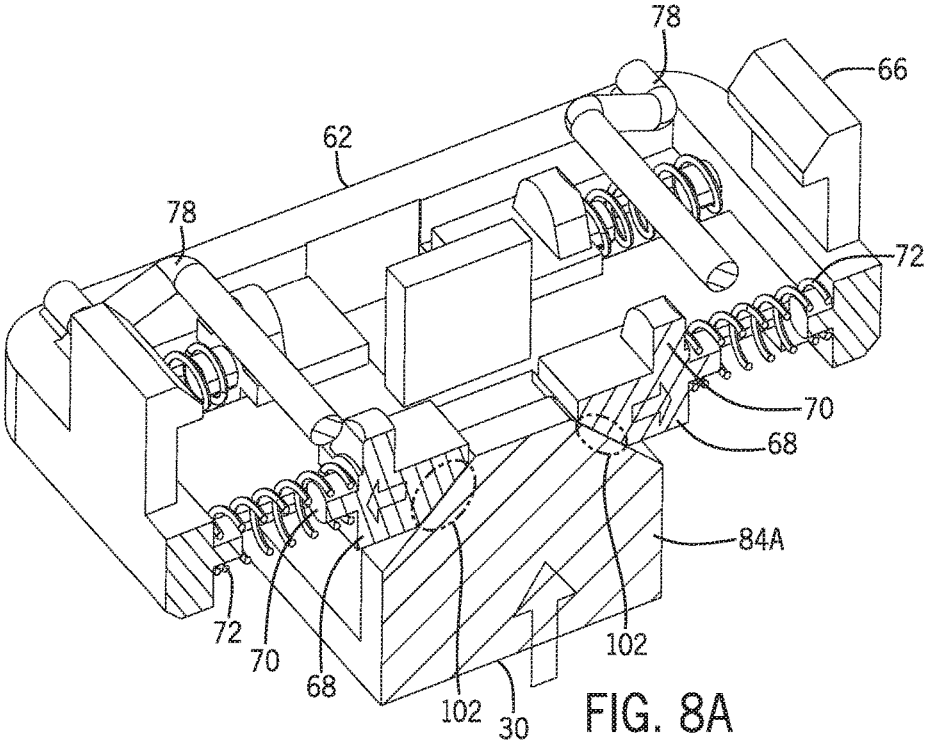
FIG. 8A is a section view of FIG. 3 when a key is placed at a base in the unkeyed configuration.

The keying process described above is depicted by FIGS. 8A, 8B, 8C, and 8D. FIG. 8A is an inverted section view of the top cover assembly 62 in the unkeyed configuration with a key 30 being placed at the entrance. As the key 30 is pushed into the keying base 32, the keying fins 84 come into contact with the lock pins 68. As the key 30 is further pushed into the keying base 32, a camming action 102 takes place between the key and the lock pins 68, forcing the lock pins away from the default biased position.

Figure 8B:
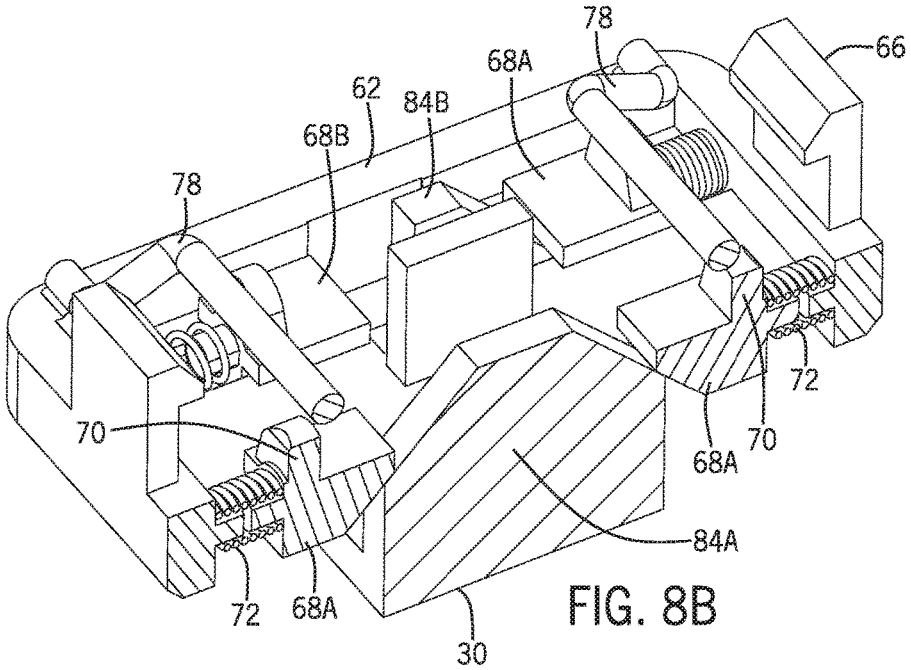
FIG. 8B is a section view of FIG. 3 when the a key is pushed into a base in the unkeyed configuration.

FIG. 8B shows the displaced lock pins 68A and a non-displaced lock pin 68B. A dual sided keying fin 84A affects lock pins 68A on both sides of keying base 32. However, a single sided keying fin 84B only affects one lock pin 68A. In another embodiment, a key 30 may include a keying fin 84 that does not interact on either side with lock pin 68. This variation in keying fins 84 allows for multiple different configurations of lock pins 68 and therefore keying combinations. Additionally, although the present embodiment employs three sets of opposing lock pins 68, it would be obvious to increase or decrease the number of sets of lock pins or employ lock pins only on one side dependent upon the application and the number of desired combinations.

Figure 8C:
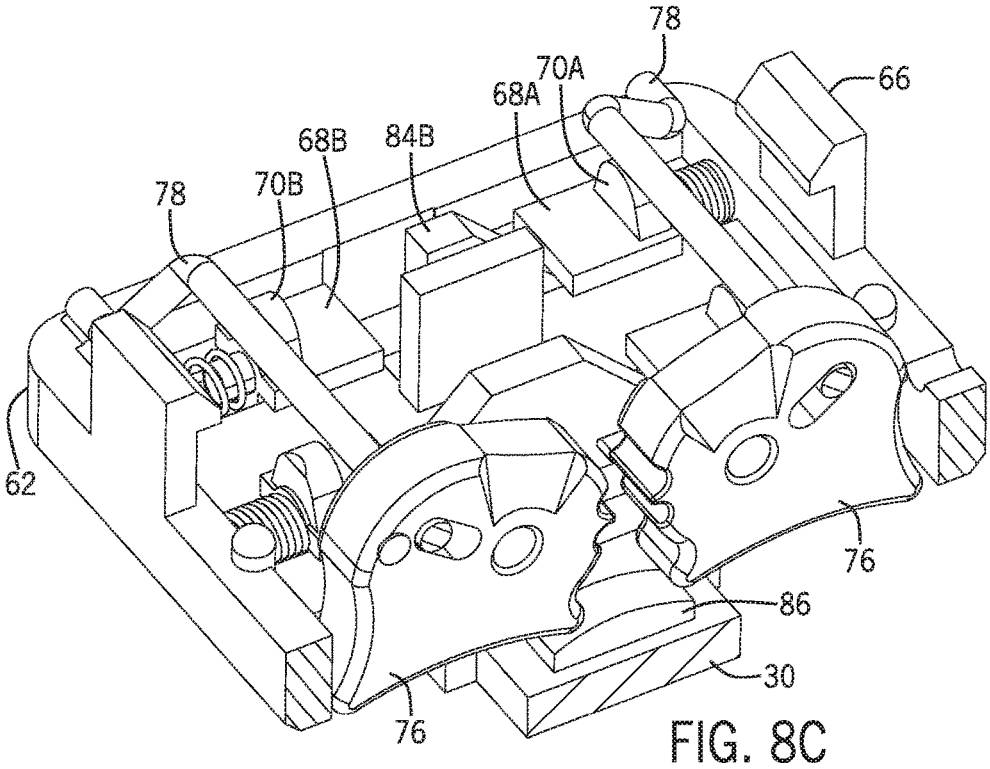
FIG. 8C is a section view of FIG. 3 when the a key is pushed into a base in the unkeyed configuration.
Figure 8D:
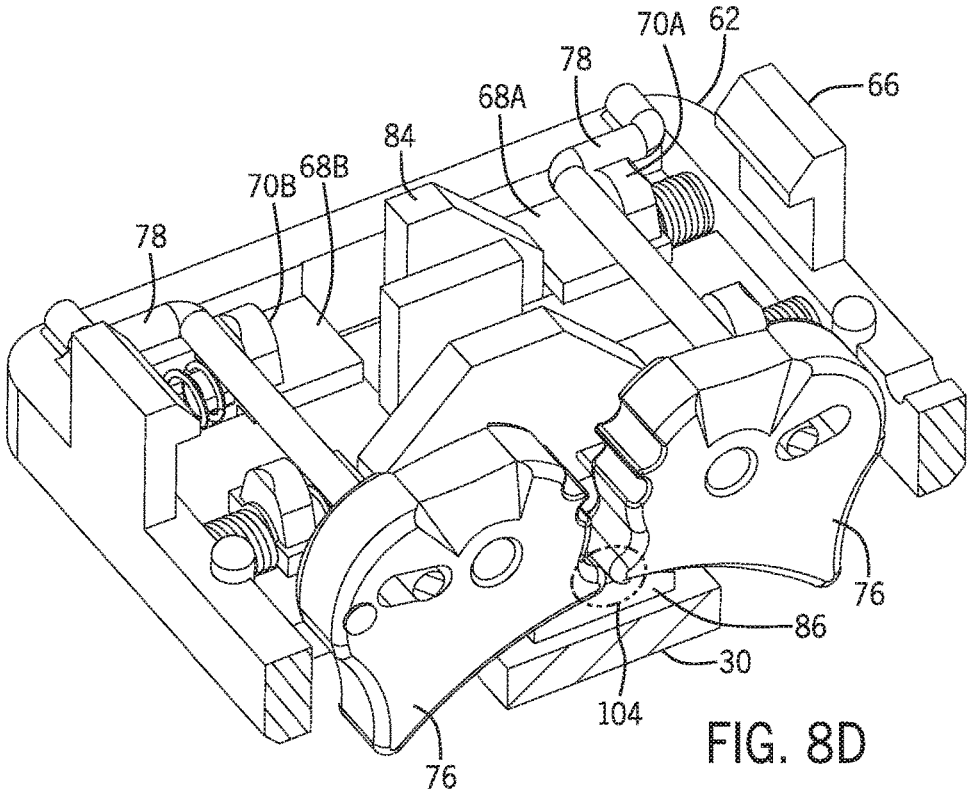
FIG. 8D is a section view of FIG. 3 when the a key is pushed into a base in the unkeyed configuration and keys the base.

FIG. 8C shows the key 30 in the same position relative to the keying base 32 as FIG. 8B, however the section view also includes the maintaining levers 76 and the lever actuator 86 on the key. These lever actuators 76 have interface slots through which the blocking bars 78 are actuated. When the key 30 is fully inserted, as shown in FIG. 8D, the lever actuator 86 contacts the maintaining levers 76 at reference point 104, causing the maintaining levers to pivot and the blocking bars to travel into the path of the lock pins 68.

When the blocking bar 78 is actuated by the maintaining levers 76, the blocking bar travels to a position in front of or behind the pin backs 70 of the lock pins 68. The pin backs 70 protrude from the lock pins 68 in so that the lock pins may be held in a keyed position when the key 30 is removed. As depicted in FIG. 8D, the blocking bar 78 holds the lock pins 68A in the displaced position, and lock pin 68B in the default biased position. With the blocking bar 78 in the keyed position, the lock pins 68 are unable to move from their respective keyed positions, being displaced or in the default biased position. Therefore, when a key 30 that is not compatible with the then keyed configuration is inserted, the key will be rejected by the immobile lock pins 68B in the default biased position. However, a key 30 that is compatible with the then keyed configuration will be accepted, as the lock pins 68A are already displaced out of the way of the keying fins 84. In the present embodiment each lock pin 68 has two positions making the lock pins binary. However, as will be appreciated by those skilled in the art, multiple keyed positions could be achieved by each lock pin 68 to increase the variety of configurations. For example, this may be achieved by employing multiple protrusion lengths of the keying fins 84, utilizing multiple blocking bars, and/or utilizing multiple pin backs 70 on a single lock pin 68.

It should be noted that some keys 30 with fewer or no keying fins 84 may be compatible with multiple keyed lock pin configurations. For example, a "master key" may have no keying fins 84 and would be accepted in any keyed keying base 32. The "master key," having no keying fins 84, would not be rejected by a lock pin 68B that is in the default biased position, as there would be no keying fin to make contact with the lock pin. Such a key 30 may be utilized in any employment where the electrical connection 28 to be made desired with terminal bases 24 of multiple keyed configurations such as a diagnostic tool, programming tool, or an I/O module 26 universal to the network 34. It may be noted that lock pin configurations, slot configurations, and key configurations may be altered to increase or decrease prolificacy of compatible keys to a single keyed configuration to reduce user error or confusion.

Figure 9A:
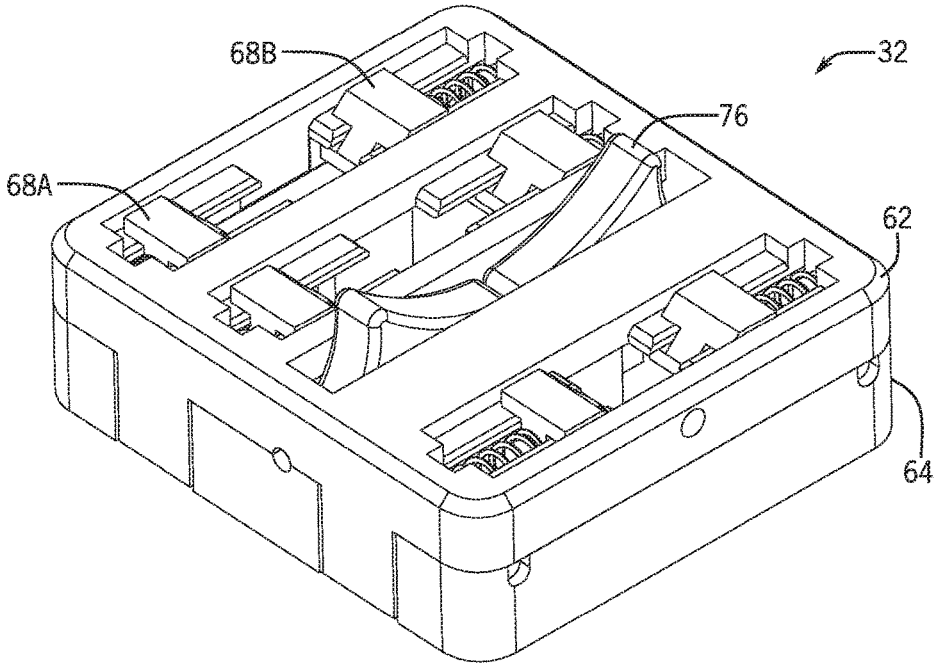
FIG. 9A is an illustration of a base in the keyed configuration.

FIG. 9A illustrates the keying base 32 in the keyed configuration. The key 30 is removed, however the lock pins 68A retain their displaced position. Additionally, lock pin 68B is in the default biased position, but remains immobile due to the blocking bar 78 and ready to reject an incompatible key 30. Also, tips of the maintaining levers 76 are accessible through the open slot 74. The detent 82 in the bottom cover assembly 64 resists the forces handling and gravity on the maintaining levers 76. This restrains the maintaining levers 76 from inadvertently releasing the blocking bars 78 and resetting the keying base 32 to the unkeyed configuration.

Figure 9B:
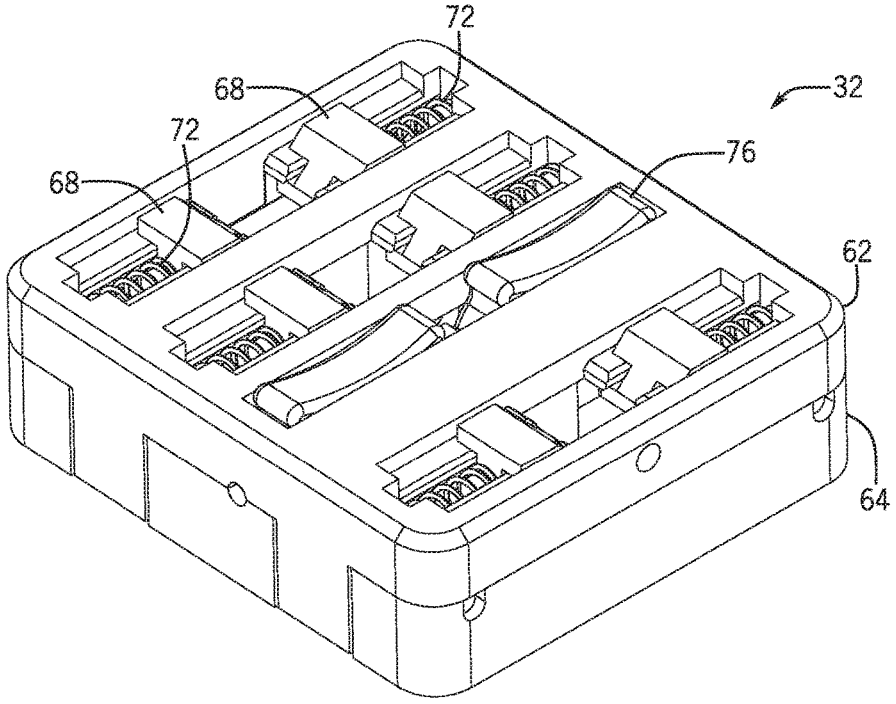
FIG. 9B is an illustration of a base in the unkeyed configuration.

Moreover, the a reset of the keying base 32 may be achieved quickly and without the use of tools by introducing a small force on the maintaining levers 76 to overcome the detent 82. FIG. 9B illustrates the keying base 32 in the unkeyed configuration. The lock pins 68 are returned to their default biased positions and may be displaced with the insertion of a key 30 into the keying base 32 by keying fins 84. The keying base 32 is thus ready for the self-keying process to begin.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A keying system for an automation device, comprising:

an input/output (I/O) terminal base;

an I/O module mountable on the terminal base and that, in operation, exchanges I/O signals with external devices via the terminal base, the I/O module comprising a key;

a locking assembly on the terminal base and comprising:

a housing having parallel slots, a plurality of lock pins movable in the slots between a first, biased position and a second position and each having a locking structure, a blocking member that, in operation, is actuated to interface with the locking structures to block each of the lock pins in the respective first or second position; and a maintaining member that, in operation, contacts the blocking member to maintain the blocking member in a blocking position in which each of the lock pins is blocked in the respective first or second position;

wherein each lock pins can be displaced between the respective first and second positions by a key having engaging surfaces that contact the lock pins to define keyed positions of the lock pins, and wherein the blocking member blocks the lock pins in their keyed positions and the maintaining member maintains the blocking member in blocking position and thereby blocking mounting of other I/O modules not having the key.

2. The system of claim 1, wherein the lock pins are disposed on opposite sides of the slots, and wherein the system comprises first and second blocking members to block the lock pins on either side.

3. The system of claim 2, comprising first and second maintaining members to maintain the first and second blocking members in their relative blocking position.

4. The system of claim 2, wherein the lock pins are symmetrically disposed on the opposite sides of the slots.

5. The system of claim 1, wherein the locking structure of each lock pin is configured to provide only two blocked positions of each lock pin.

6. The system of claim 1, wherein the lock pins are biased by a compression spring.

7. The system of claim 1, wherein the lock pins are manually resettable to the biased positions.

8. The system of claim 7, wherein the lock pins are manually resettable to the biased positions by manual movement of the maintaining member.

9. The system of claim 1, wherein the blocking member is configured to toggle between an unkeyed position and a keyed position in which the lock pins are maintained in their keyed positions.

10. The system of claim 1, wherein, in operation, the terminal base is hard-wired to I/O devices and the I/O module is configured to process signals from the hard-wired I/O devices uniquely based upon how the hard-wired I/O devices are connected to the terminal base.

11. A keying system for an automation device, comprising:

a base configured to perform an automation operation;

a modular automation device mountable on the base and that, in operation, exchanges signals with the base, the modular automation device comprising a key;

a locking assembly on the base and comprising:

a housing having parallel slots, a plurality of lock pins movable in the slots between a first, biased position and a second position and each having a locking structure, a blocking member that, in operation, is actuated to interface with the locking structures to block each of the lock pins in the respective first or second position; and a maintaining member that, in operation, contacts the blocking member to maintain the blocking member in a blocking position in which each of the lock pins is blocked in the respective first or second position;

wherein each lock pins can be displaced between the respective first and second positions by a key having engaging surfaces that contact the lock pins to define keyed positions of the lock pins, and wherein the blocking member blocks the lock pins in their keyed positions and the maintaining member maintains the blocking member in blocking position and thereby blocking mounting of other modular automation devices not having the key.

12. The system of claim 11, wherein the lock pins are manually resettable to the biased positions.

13. The system of claim 12, wherein the lock pins are manually resettable to the biased positions by manual movement of the maintaining member.

14. The system of claim 11, wherein the lock pins are disposed on opposite sides of the slots, and wherein the system comprises first and second blocking members to block the lock pins on either side.

15. The system of claim 11, wherein the locking structure of each lock pin is configured to provide only two blocked positions of each lock pin.

16. A keying method for an automation device, comprising:

in a system that comprises an input/output (I/O) terminal base and an I/O module mountable on the terminal base and that, in operation, exchanges I/O signals with external devices via the terminal base, the I/O module comprising a key, biasing a plurality of lock pins each movable between a first, biased position and a second position;

actuating a blocking member to interface with locking structures of the lock pins to block each of the lock pins in the respective first or second position; and contacting the blocking member with a maintaining member to maintain the blocking member in a blocking position in which each of the lock pins is blocked in the respective first or second position;

wherein each lock pins can be displaced between the respective first and second positions by a key having engaging surfaces that contact the lock pins to define keyed positions of the lock pins, and wherein the blocking member blocks the lock pins in their keyed positions and the maintaining member maintains the blocking member in blocking position and thereby blocking mounting of other I/O modules not having the key.

17. The method of claim 16, comprising resetting the lock pins to the biased positions by movement of the maintaining member.

18. The method of claim 17, wherein the lock pins are manually resettable to the biased positions by manual movement of the maintaining member.

19. The method of claim 16, wherein the blocking member is configured to toggle between an unkeyed position and a keyed position in which the lock pins are maintained in their keyed positions.

20. The method of claim 16, wherein the locking structure of each lock pin is configured to provide only two blocked positions of each lock pin.

* * * * *